US005529680A

United States Patent [19]

Kitada et al.

[11] Patent Number: 5,529,680

[45] **Date of Patent: *Jun. 25, 1996**

[54] PLATINUM ELECTROFORMING AND PLATINUM ELECTROPLATING

[75] Inventors: Katsutsugu Kitada; Soumei Yarita, both of Kanagawa-ken, Japan

[73] Assignee: Electroplating Engineers of Japan, Limited, Japan

[ * ] Notice: The term of this patent shall not extend beyond the expiration date of Pat. No. 5,310,475.

[21] Appl. No.: 377,456

[22] Filed: Jan. 24, 1995

Related U.S. Application Data

[63] Continuation-in-part of Ser. No. 237,693, May 4, 1994, which is a continuation of Ser. No. 718,767, Jun. 21, 1991, Pat. No. 5,310,475.

[30] Foreign Application Priority Data

| | | | |
|---|---|---|---|
| Jun. 29, 1990 | [JP] | Japan | 2-170064 |
| Jul. 16, 1990 | [JP] | Japan | 2-185241 |
| Apr. 30, 1991 | [JP] | Japan | 3-124577 |
| Apr. 30, 1991 | [JP] | Japan | 3-124578 |
| Apr. 30, 1991 | [JP] | Japan | 3-124579 |

[51] Int. Cl.[6] ..... C25D 1/00

[52] U.S. Cl. ..... 205/67; 205/69; 205/70; 205/72; 205/73; 205/264

[58] Field of Search ..... 205/70, 72, 73, 205/67, 69, 264

[56] References Cited

U.S. PATENT DOCUMENTS

| | | | |
|---|---|---|---|
| Re. 34,862 | 2/1995 | Czor | 205/72 |
| 5,310,475 | 5/1994 | Kitada et al. | 205/72 |

OTHER PUBLICATIONS

Indira et al, "Addition Agent for Platinum Plating", Metal Finishing, May 1969, pp. 44–49.

*Primary Examiner*—John Niebling
*Assistant Examiner*—Kishor Mayekar
*Attorney, Agent, or Firm*—Klauber & Jackson

[57] ABSTRACT

The invention relates to platinum electroforming and platinum electroplating capable of preparing a deposited platinum material having high hardness and increased thickness and size utilizing an electrolyte bath comprising at least one compound selected from the group consisting of chloroplatinic acid, chloroplatinates of alkali metals, hydrogen hexahydroxoplatinate, and hexahydroxoplatinates of alkali metals, 2–100 g/l as platinum; a hydroxylated alkali metal, 20–100 g/l; and a soluble carboxylate.

12 Claims, 1 Drawing Sheet

PLATINUM ELECTROFORMING AND PLATINUM ELECTROPLATING

RELATED APPLICATIONS

This application is a continuation-in-part of our application Ser. No. 08/237,693, filed May 4, 1994, which is a continuation of application Ser. No. 07/718,767, filed Jun. 21, 1991, now U.S. Pat. No. 5,310,475, each of which is incorporated herein by reference in its entirety.

BACKGROUND OF THE INVENTION

1. Field of the Invention

The present invention relates to a platinum electroforming and also to a platinum electroplating.

Platinum has widely been used as ornaments or accessories because of its clean and subdued shine, although it has a less loud color than gold. Platinum is also highly resistant to corrosion and gives a catalytic effect, and thus it can be adopted as materials for products used in industries.

Platinum, however, has an inherent tenacity, which brings about a decreased workability of platinum. A high degree of technical skill of a professional workman is imperative especially for the working of accessories such as earrings or brooches which requires elaborate workmanship for the manufacture.

Furthermore, inasmuch as the specific gravity of platinum is higher, for example, than that of white gold made of an alloy of gold and silver, it cannot be made into large-sized accessories as are worn on a personal body. There have been limitations on the size of such commercial platinum products.

For these reasons, the present inventor has undertaken studies pertinent to a platinum electroforming method to solve the above-mentioned problems, i.e., the limitations on workability and size. Specifically, these studies have been directed to a method including the stages of forming by means of electrodeposition thick deposition layer of platinum on the surface of a mother die to which a release coat has been applied and releasing the deposited layer from the mother die to obtain an electroformed product of platinum having opposite convex and concave surfaces to those of the mother die. Adding to these stages, the method may include the stages of applying a release coat to the surface of the resultant electroformed product and treating by means of electrodeposition to obtain a product of platinum having the same convex and concave surfaces as those of the mother die. If the electroforming method may be materialized, it may simultaneously solve the problems such as the deficient workability and the limitation on size of platinum as aforementioned since it allows to conveniently prepare hollow products of platinum or products with a film of any thickness of platinum.

The limitations on workability and size are also solved by platinum electroforming on a mandrel. This method results in light weight, hollow articles, which are especially valuable in the field of jewelry making. There may be other applications as well.

2. Description of the Prior Art

From the above reasons, there has been a great demand for the electroforming of platinum. In fact, various studies on the electroforming of platinum have been conducted. However, no successful process has been completed so far. This is because a thickness of a deposited layer to be required in the electroforming is about 10–50 times as large as usual electroplating (for example, Japanese Patent Laid open Publication No. 107,794/1990). Specifically, one will fail to prepare the deposited layer of such a thickness because deposited platinum has a tendency to occlude hydrogen, which increases an internal stress of the deposited layer, resulting in generation of cracks (micro crevices). Thus, one cannot obtain the desirable deposited layer having sufficient strength and thickness to be used for commercial products. In particular, special consideration must be given to physical and mechanical properties of the deposited layer, since such layer per se becomes a product of electroforming. The generation of cracks may therefore cause fatal problems to the electroformed products.

In addition, a general platinum metal, which is not a deposited metal prepared by electroforming or electroplating, has a crystal structure of face centered cubic lattice. Also, it is soft (approximately 40 Hv) and ductile. However, ornaments, e.g., rings, necklaces made of platinum having these characteristics possess the drawbacks of being easily scratched and deformed because they are soft and abradable.

Because of these reasons, platinum is conventionally alloyed with other metals to increase hardness for manufacturing ornaments using platinum. This method, though it allows the hardness of the platinum alloy to increase, however, causes generation of intermetallic compounds in the platinum alloy to result in brittleness of the platinum alloy. This method also has the disadvantage of generation of an oxide film in the steps of heating or brazing a platinum alloy, thereby reducing the external quality of the platinum alloy. Accordingly, it is desirable to utilize means other than such alloying methods to improve the hardness of a platinum alloy.

SUMMARY OF THE INVENTION

A method for preparing a hollow platinum product has been discovered. Thus, in accordance with a first embodiment of the invention, a layer of platinum material is electrodeposited onto a mandrel having a predetermined shape, in a platinum electrolyte bath. The platinum electrolyte bath comprises at least one compound selected from the group consisting of chloroplatinic acid, chloroplatinates of alkali metals, hydrogen hexahydroxoplatinate, and hexahydroxoplatinates of alkali metals, 2–1000 g/l as platinum; and a hydroxylated alkali metal, 20–100 g/l, and a soluble carboxylate. The platinum layer is then released from the mandrel.

One of the objects of the present invention is to provide a platinum electrolyte bath capable of producing a platinum deposit having a considerable strength and thickness.

It is another object of the present invention to provide a method for preparing a platinum material having high hardness by adopting electrodeposition from a platinum electrolyte bath (electroforming or electroplating bath) as means for improving the hardness of platinum.

A third object of the present invention is to produce, by a platinum electroforming method, hollow platinum products.

Other objects, features and advantages of the invention, will hereinafter become more readily apparent from the following description.

DESCRIPTION OF PREFERRED EMBODIMENTS

The platinum electroforming or electroplating bath according to the present invention comprises:

at least one compound selected from the group consisting of chloroplatinic acid, chloroplatinates of alkali metals, hydrogen hexahydroxoplatinate, and hexahydroxoplatinates of alkali metals, preferably 2–100 g/l as platinum; and a hydroxylated alkali metal, preferably 20–100 g/l; and a soluble carboxylate.

As a salt of platinum, chloroplatinic acid [$H_2PtCl_6$] or hydrogen hexahydroxoplatinate [$H_2Pt(OH)_6$] is preferable. Their salts of alkali metals are also preferable. Among these salts, sodium chloroplatinate [$Na_2PtCl_6$], potassium chloroplatinate [$K_2PtCl_6$], and the like are preferable as the chloroplatinate of alkali metals, and sodium hexahydroxoplatinate [$Na_2Pt(OH)_6.2H_2O$], potassium hexahydroxoplatinate [$K_2Pt(OH)_6$], and the like are preferable as the hexahydroxoplatinate of alkali metals. A preferable amount of these platinum salts to be incorporated is 2–100 g/l as platinum.

Preferable examples of the hydroxylated alkali metals are potassium hydroxide and sodium hydroxide. The hydroxylated alkali metal is incorporated in order to dissolve platinum.

Given as examples of preferable soluble carboxylate are potassium or sodium salts of acetic acid, oxalic acid, citric acid, malic acid, propionic acid, lactic acid, malonic acid, tartaric acid, and the like. Preferable examples of the phosphate are potassium phosphate, sodium phosphate, dipotassium hydrogenphosphate, potassium hydrogen phosphate, sodium hydrogenphosphate, and the like. As the sulfate, potassium sulfate, sodium sulfate, and the like are preferable.

Such a soluble carboxylate or the like acts as a stabilizer in the electroforming or electroplating bath. It is preferably incorporated in an amount of 2–200 g/l.

In addition to the above components, the electroforming or electroplating bath of platinum may include additives such as various brightening agents, electroconductive salts, and the like.

Additionally, a platinum alloy can be deposited by incorporating other metal salts in the electroforming or electroplating bath. Preferable examples of metals adapted to make an alloy with platinum are gold, silver, palladium, iridium, ruthenium, cobalt, nickel, copper, and the like. The number of other metals incorporated in the bath is not restricted to one. Two kinds of metals can be incorporated to make an alloy with platinum, for example, an alloy of platinum-palladium-copper.

A preferable operating temperature for the electroforming or electroplating bath is not lower than 65° C., with the temperature of not lower than 80° C. being particularly preferable. Generally, a current density is preferably 1–3 ASD, when platinum is contained in the amount of 20 g/l, though it depends on electroplating conditions.

A platinum metal produced by means of electrodeposition from the platinum electrolyte bath has a reduced crystal size. The platinum metal has also a hardness of at least 100–350 Hv. Such hardness is greatly higher than that of a platinum metal, i.e., about 40 Hv, prepared by general melting procedures.

There is the following relationship between the purity and hardness of the platinum material prepared by the method of the present invention:

| Purity (Wt %) | Hardness |
|---|---|
| 99.9 | Above 100 $H_v$ |
| 95.0–99.9 | Above 200 $H_v$ |
| 90.0–95.0 | Above 250 $H_v$ |
| 85.0–90.0 | Above 300 $H_v$ |

Microscopic and macroscopic stresses are involved in the platinum metal obtained by means of electrodeposition. The microscopic stress which is a non-uniformed stress corresponding to an expanded width of X-ray diffraction lines causes the increased hardness of the deposited metal. While the macroscopic stress is a residual tensile or compressive stress involved in the deposited platinum metal and makes a cause of strain or cracks. The macroscopic stress of platinum is very large. The macroscopic stress, however, can be restrained by adopting an alkaline platinum electrolyte bath or by annealing (heat treatment) for each additional thickness of about 5–10 μm of a deposited layer. The annealing is performed under heating, preferably, at 400°–900° C. for 30–120 min. By the annealing, the hardness of the platinum metal may be reduced. Such degree of the reduced hardness is nevertheless higher than that of conventional platinum metals. Accordingly, the deposited layer having sufficiently large thickness and size can be provided, and thus platinum products having high hardness can be manufactured by means of, namely, the electroforming.

As a platinum electrolyte bath when adopting a means of platinum electroforming or electroplating to improve the hardness of platinum, an alkaline bath is very advantageous from the aspect of deposition efficiency, a macroscopic stress, and the like. In this respect, the platinum electrolyte bath includes one or more platinum compounds selected from-the group consisting of tetrachloroplatinate, hexachloroplatinate, tetrabromoplatinate, hexabromoplatinate, hexahydroxoplatinate, diaminedinitroplatinum, tetranitroplatinate, and the like; and one or more compounds selected from the group consisting of hydroxylated alkali metals, ammonia, conductive salts, and the like, and, as required, may include alloying metal salts.

Stated additionally, the annealing is not necessary when using as the platinum electrolyte bath the previously mentioned composition comprising:

at least one compound selected from the group consisting of chloroplatinic acid, chloroplatinates of alkali metals, hydrogen hexahydroxoplatinate, and hexahydroxoplatinates of alkali metals, 2–100 g/l as platinum; and a hydroxylated alkali metal, 20–100 g/l; and a soluble carboxylate.

DETAILED DESCRIPTION

Figure 1:
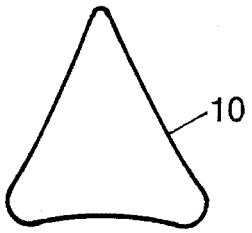
FIG. 1 is a plan view of a mandrel (i.e. a mold) which may be utilized to form an article such as an earring by electrodeposition in accordance with the invention.

Generally thin hollow platinum articles can be produced by electroforming. FIG. 1 illustrates one example of a mandrel 10 which can be made from various materials so as to be permanent or expendable. All non-metallic mandrels must be metalized to yield an electrically conductive surface. Metalizing may be accomplished using, for example, graphite powder or a silvering procedure. The material of the permanent mandrel could be, for example, metallic, metalized plastic or wood which has been sealed to prevent absorption. The sealing agent may be, for example, liquid resin, acid resistent varnish, silicon or graphite powder. These materials may also serve as releasing agents since subsequent separation of the electroform from the permanent mandrel requires that the mandrel be treated with a releasing agent. An expendable mandrel may be of a material such as wax, plastic, low melting or fusible metal, soluble metal or plaster. The electroform is separated from an expendable mandrel by various methods. An expendable mandrel of a fusible metal material may be separated from the electroform by melting the fusible metal using, for example, a silicone-based oil having a flash point considerably higher than the melting point of the fusible metal. An expendable mandrel made of a soluble metal may be chemically removed. A plastic or wax expendable mandrel may be softened by heat for removal from the electroform. An expendable mandrel made of plaster can be broken away from the electroform.

When manufacturing a mandrel, the side that interfaces with the electroform must be well finished and smoothed, since it will be reproduced exactly on the electroform. Permanent mandrels must be designed with sufficient draft or taper to permit withdrawal of the mandrel without damaging either the electroform or the mandrel.

The mandrel is cleaned to ensure uniform coverage by the electroform then submerged into the platinum electrolyte bath. The composition of the platinum electrolyte bath has been described.

Figure 2:
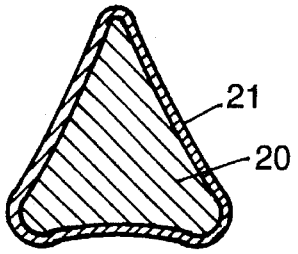
FIG. 2 is a cross-sectional view of a shaped expendable mandrel having a platinum coating thereon.
Figure 3:
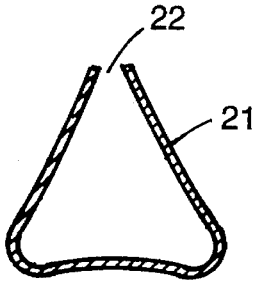
FIG. 3 is the same view of the apparatus of FIG. 2 showing the expendable mandrel having been removed from the platinum coating.
Figure 4:
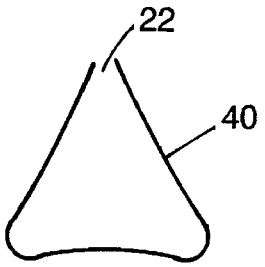
FIG. 4 is a plan view of the hollow platinum product in the shape of the mandrel of FIG. 1 after the mandrel has been removed.
Figure 5:
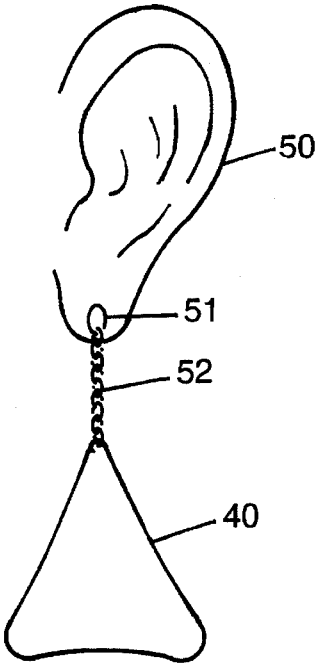
FIG. 5 is a plan view of an ornamental earring containing the hollow platinum product of FIG. 4.

During submersion in the bath, as shown in FIG. 2, a layer of platinum material 21 is electrodeposited onto a shaped, expendable mandrel 20. The shaped expendable mandrel is removed from within the platinum layer 21 through a small hole 22 in said layer, as illustrated in FIG. 3 by one of the methods previously mentioned. A hollow platinum product 40 containing small hole 22 results in the shape of the mandrel 10 (of FIG. 1) as illustrated in FIG. 4. One example of how hollow platinum product 40 can be utilized is shown in FIG. 5, which illustrates an ornamental earring comprising a conventional hook or clasp 51 to be affixed to ear 50, a chain 52 attached at one end to hook or clasp 51 and attached at its other end to hollow platinum product 40.

Other features of the invention will become apparent in the course of the following description of the exemplary embodiments which are given for illustration of the invention and are not intended to be limiting thereof.

EXAMPLE 1

A preferable example of the electroforming of the present invention is herein illustrated.

TABLE 1

(Composition of a Platinum Electroforming Bath)

| | |
|---|---|
| Hydrogen Hexahydroxoplatinate $[H_2Pt(OH)_6]$ | 30 g/l |
| Potassium Acetate $[KCH_3CO_2]$ | 40 g/l |
| Potassium Hydroxide [KOH] | 60 g/l |

pH: 13.5

A test was performed using the above electroforming bath shown in Table 1 under the different conditions with respect to the time and the current density to deposit a deposition layer of platinum on the surface of a test piece of brass.

The results are shown in Table 2. The deposition layers obtained all exhibited an excellently glossy appearance. Observation under microscope showed no existence of cracks. Further, the deposition layers had an increased thickness in proportion to the electroforming time. These results demonstrate that the bath can be used as an electroforming bath. Accordingly, light and large-sized earrings or brooches with a hollow construction can be produced by the method using the electroforming bath of the present invention. Also, elaborate works can be achieved without using high technical skill.

TABLE 2

| No. | Electro-Forming min | Current Density ASD | Deposition Efficiency mg/A · min | Thickness of Deposition ρm |
|---|---|---|---|---|
| 1 | 4 | 3 | 29.3 | 1.64 |
| 2 | 4 | 3 | 29.6 | 1.66 |
| 3 | 60 | 3 | 29.6 | 24.8 |
| 4 | 153 | 2 | 29.2 | 41.7 |
| 5 | 240 | 2 | 29.3 | 65.6 |
| 6 | 265 | 2 | 29.5 | 72.9 |
| 7 | 180 | 3 | 29.4 | 74.0 |
| 8 | 480 | 2.3 | 29.5 | 150 |

EXAMPLE 2

In this example, an experiment of producing an insoluble platinum electrode was performed by electroplating platinum on titanium. A electroplating bath having the same composition as that of the electroforming bath shown in Table 1 was used in this example. The electroplating was carried out using this electroplating bath under the following operating conditions.

Electroplating method: dip plating

Bath temperature: 80° C.

Current density: 3 ASD

Electroplating time: 10 min

Inspection of the insoluble platinum electrode obtained revealed that an adhesive platinum layer having a glossy surface with a thickness of 4 μm was formed. The surface of the platinum layer was observed under a microscope to show that any pin hole or crack did not occur. It was confirmed that a uniform current distribution could be obtained when this insoluble platinum electrode was used as an electrode in practice and also that the platinum layer on the surface of the electrode was never peeled off from titanium which was a metal underneath over a prolonged period of time.

The platinum electroplating according to the present invention, however, is not restricted to use in a field of the above insoluble platinum electrode, but can be applied to, for example, the formation of a platinum layer on a heat resisting section of a jet turbine.

EXAMPLE 3

Electroforming was carried out using the electrolyte baths No. 1–11 having the compositions and conditions as tabulated below to deposit platinum on a test piece of brass, while deposited layers were annealed during the above procedures when their microscopic stresses were high. The deposited layers (platinum material) obtained had high hardness, the surface thereof being smooth. Also, the flexibility of the deposited layer stood comparison with that of ordinary platinum.

| Electrolyte Bath No. 1 | |
|---|---|
| Composition | |
| Pt [as $Pt(NH_3)_2NO_2)_2$] | 10 g/l |
| $C_5H_5N$ | 200 ml/l |
| $NH_3$ | 100 ml/l |
| Condition | |
| pH | 13 (adjusted by NaOH) |
| Temperature | 75° C. |
| Current density | 1.0 A/dm$^2$ |
| Deposition efficiency | 45 mg/A · min |
| Electrolytic time | 240 min |
| Deposited layer | |
| Thickness | 48 μm |
| Purity | 99.95 wt % |
| Hardness | 270 $H_v$ |

| Electrolyte Bath No. 2 | |
|---|---|
| Composition | |
| Pt [as $Pt(NH_3)_2(NO_2)_2$] | 10 g/l |
| $C_5H_5N$ | 200 ml/l |
| $NH_3$ | 100 ml/l |
| $CuSO_4.5H_2O$ | 1.97 g/l |
| Condition | |
| pH | 11 |
| Temperature | 65° C. |
| Current density | 1.0 A/dm$^2$ |
| Deposition efficiency | 30.4 mg/A · min |
| Electrolytic time | 360 min |
| Deposited layer | |
| Thickness | 48 μm |
| Purity | 99.97 wt % |
| Hardness | 330 $H_v$ |

| Electrolyte Bath No. 3 | |
|---|---|
| Composition | |
| Pt [as $K_2PtCl_4$] | 10 g/l |
| EDTA-2Na | 80 g/l |
| Condition | |
| pH | 6 |
| Temperature | 70° C. |

-continued

| | |
|---|---|
| Current density | 1.0 A/dm$^2$ |
| Deposition efficiency | 10.0 mg/A · min |
| Electrolytic time | 480 min |
| Deposited layer | |
| Thickness | 16 μm |
| Purity | 99.94 wt % |
| Hardness | 283 $H_v$ |

| Electrolyte Bath No. 4 | |
|---|---|
| Composition | |
| Pt [as $K_2[Pt(NO_2)_4]$] | 10 g/l |
| $K_2HPO_3$ | 0.5 mol/l |
| $KNO_3$ | 0.2 mol/l |
| Condition | |
| pH | 13 (adjusted by NaOH) |
| Temperature | 60° C. |
| Current density | 1.0 A/dm$^2$ |
| Deposition efficiency | 9.4 mg/A · min |
| Electrolytic time | 480 min |
| Deposited layer | |
| Thickness | 16 μm |
| Purity | 99.97 wt % |
| Hardness | 420 $H_v$ |

| Electrolyte Bath No. 5 | |
|---|---|
| Composition | |
| Pt [as $H_2Pt(OH)_6$] | 13 g/l |
| $CH_3COONa$ | 0.5 mol/l |
| EDTA-4H | 0.05 mol/l |
| NaOH | 40 g/l |
| $NiSO_4.6H_2O$ | 0.04 mol/l |
| Condition | |
| pH | 13 |
| Temperature | 65° C. |
| Current density | 1.0 A/dm$^2$ |
| Deposition efficiency | 31.0 mg/A · min |
| Electrolytic time | 360 min |
| Deposited layer | |
| Thickness | 48 μm |
| Purity | 96.2 wt % |
| Hardness | 440 $H_v$ |

| Electrolyte Bath No. 6 | |
|---|---|
| Composition | |
| Pt [as $H_2Pt(OH)_6$] | 13 g/l |
| $CH_3COONa$ | 0.5 mol/l |
| EDTA-4H | 0.05 mol/l |
| NaOH | 40 g/l |
| $NiSO_4.6H_2O$ | 0.04 mol/l |
| Condition | |
| Ph | 13 |
| Temperature | 65° C. |
| Current density | 1.0 A/dm$^2$ |
| Deposition efficiency | 31.0 mg/A · min |
| Electrolytic time | 180 min |
| Deposited layer | |
| Thickness | 14 μm |
| Purity | 97.0 wt % |
| Hardness | 450 $H_v$ |

| Electrolyte Bath No. 7 | |
|---|---|
| Composition | |
| Pt [as $H_2PT(OH)_6$] | 20 g/l |

-continued

| | |
|---|---|
| KOH | 50 g/l |
| $K_2C_2O_4.H_2O$ | 30 g/l |
| Condition | |
| pH | 13.5 |
| Temperature | 90° C. |
| Current density | 3 A/dm$^2$ |
| Deposition efficiency | 30 mg/A · min |
| Electrolytic time | 240 min |
| Deposited layer | |
| Thickness | 100 μm |
| Purity | 99.9 wt % |
| Hardness | 350 $H_v$ |

Electrolyte Bath No. 8

| | |
|---|---|
| Composition | |
| Pt [as $H_2PT(OH)_6$] | 20 g/l |
| KOH | 40 g/l |
| Sn [as $K_2SnO_3.3H_2O$] | 30 g/l |
| Potassium tartrate.½$H_2O$ | 100 g/l |
| Condition | |
| pH | 13.3 |
| Temperature | 90° C. |
| Current density | 2 A/dm$^2$ |
| Deposition efficiency | 20 mg/A · min |
| Electrolytic time | 300 min |
| Deposited layer | |
| Thickness | 60 μm |
| Purity | 85 wt % |
| Hardness | 650 $H_v$ |

Electrolyte Bath No. 9

| | |
|---|---|
| Composition | |
| Pt [as $H_2Pt(OH)_6$] | 20 g/l |
| KOH | 100 g/l |
| Zn [as ZnO] | 0.8 g/l |
| Condition | |
| pH | 14 |
| Temperature | 90° C. |
| Current density | 2 A/dm$^2$ |
| Deposition efficiency | 30 mg/A · min |
| Electrolytic time | 180 min |
| Deposited layer | |
| Thickness | 50 μm |
| Purity | 95 wt % |
| Hardness | 450 $H_v$ |

Electrolyte Bath No. 10

| | |
|---|---|
| Composition | |
| Pt [as $H_2PtCl_6$] | 10 g/l |
| $C_5H_5N$ | 200 ml/l |
| $NH_3$ | 100 ml/l |
| $Na_2CO_3$ | 0.1 mol/l |
| Pd [as cis-$Pd(NH_3)_2(NO_2)_2$] | 1 g/l |
| Condition | |
| pH | 12 (adjusted by NaOH) |
| Temperature | 75° C. |
| Current density | 1.0 A/dm$^2$ |
| Deposition efficiency | 32.2 mg/A · min |
| Electrolytic time | 180 min |
| Deposited layer | |
| Thickness | 25 μm |
| Purity | 85.6 wt % |
| Hardness | 505 $H_v$ |

-continued

Electrolyte Bath No. 11

| | |
|---|---|
| Composition | |
| Pt [as $H_2PtCl_6$] | 10 g/l |
| $C_5H_5N$ | 200 ml/l |
| $NH_3$ | 100 ml/l |
| $Na_2CO_3$ | 0.1 mol/l |
| Pd [as cis-$Pd(NH_3)_2(NO_2)_2$] | 1 g/l |
| Condition | |
| pH | 12 (adjusted by NaOH) |
| Temperature | 75° C. |
| Current density | 1.0 A/dm$^2$ |
| Deposition efficiency | 32.2 mg/A · min |
| Electrolytic Time | 360 min |
| Deposited layer | |
| Thickness | 49 μm |
| Purity | 87.0 wt % |
| Hardness | 410 $H_v$ |

What is claimed is:

1. A method for preparing a hollow platinum product comprising electroforming a layer of platinum material onto a mandrel, in a platinum electrolyte bath, wherein the platinum electrolyte bath comprises:

at least one compound selected from the group consisting of chloroplatinic acid, chloroplatinates of alkali metals, hydrogen hexahydroxyplatinate, and hexahydroxyplatinates of alkali metals, 2–1000 g/l as platinum; and a hydroxylated alkali metal, 20–100 g/l, and a soluble carboxylate; and releasing said layer of platinum material from the mandrel;

said layer throughout a thickness range of 1.64–150 μm shows no crack under microscopic examination.

2. The method according to claim 1, wherein the soluble carboxylate is present in the bath in an amount of 2–200 g/l.

3. The method according to claim 1, wherein the mandrel is permanent.

4. The method according to claim 3, wherein the permanent mandrel is treated with a releasing agent to permit separation.

5. The method according to claim 1, wherein the mandrel is expendable.

6. The method according to claim 1, wherein said platinum electrolyte bath further comprises alloying metal salts and whereby said layer of platinum material comprises a platinum alloy.

7. The method according to claim 1, wherein said layer of platinum material is electroformed at a temperature of not lower than 65° C.

8. The method according to claim 1, wherein said platinum electrolyte bath is comprised of $H_2Pt(OH)_6$, KOH and $K_2C_2O_4H_2O$.

9. A hollow platinum product having a purity of above 99.9 wt % and hardness of above 100 $H_v$, which is prepared by the method according to claim 1.

10. A hollow platinum product having a purity of not less than 95.0 wt % and of less than 99.9 wt % and a hardness of above 200 $H_v$, which is prepared by the method according to claim 1.

11. A hollow platinum product having a purity of not less than 90.0 wt % and of less than 95.0 wt % and a hardness of above 250 $H_v$, which is prepared by the method according to claim 1.

12. A platinum product having a purity of not less than 85.0 wt % and of less than 90.0 wt % and a hardness of above 300 $H_v$, which is prepared by the method according to claim 1.

* * * * *